US007815339B2

(12) United States Patent
Veenstra et al.

(10) Patent No.: US 7,815,339 B2
(45) Date of Patent: Oct. 19, 2010

(54) LIGHT MODULE

(75) Inventors: Thomas J. Veenstra, Zeeland, MI (US); David L. Hiemstra, Hudsonville, MI (US); Scott C. Heupel, Wyoming, MI (US)

(73) Assignee: Innotec Corporation, Zeeland, MI (US)

( * ) Notice: Subject to any disclaimer, the term of this patent is extended or adjusted under 35 U.S.C. 154(b) by 50 days.

(21) Appl. No.: 12/351,380

(22) Filed: Jan. 9, 2009

(65) Prior Publication Data

US 2009/0175044 A1 Jul. 9, 2009

Related U.S. Application Data

(60) Provisional application No. 61/019,988, filed on Jan. 9, 2008.

(51) Int. Cl.
*F21V 33/00* (2006.01)

(52) U.S. Cl. ..... 362/249.02; 362/800; 362/311.02

(58) Field of Classification Search ..... None
See application file for complete search history.

(56) References Cited

U.S. PATENT DOCUMENTS

| | | | |
|---|---|---|---|
| 5,355,245 | A | 10/1994 | Lynam |
| 5,371,659 | A | 12/1994 | Pastrick et al. |
| 5,382,811 | A | 1/1995 | Takahashi |
| 5,404,282 | A | 4/1995 | Klinke et al. |
| 5,430,627 | A | 7/1995 | Nagano |
| 5,497,305 | A | 3/1996 | Pastrick et al. |
| 5,497,306 | A | 3/1996 | Pastrick |
| 5,499,170 | A | 3/1996 | Gagne |
| 5,530,240 | A | 6/1996 | Larson et al. |
| 5,563,422 | A | 10/1996 | Nakamura et al. |
| 5,567,036 | A | 10/1996 | Theobald et al. |
| 5,568,964 | A | 10/1996 | Parker et al. |
| 5,572,812 | A | 11/1996 | Mastuoka |
| 5,578,839 | A | 11/1996 | Nakamura et al. |
| 5,613,751 | A | 3/1997 | Parker et al. |
| 5,618,096 | A | 4/1997 | Parker et al. |
| 5,632,551 | A | 5/1997 | Roney et al. |

(Continued)

FOREIGN PATENT DOCUMENTS

| | | | |
|---|---|---|---|
| DE | 39 16 875 | A1 | 12/1990 |

(Continued)

OTHER PUBLICATIONS

International Search Report, International Application No. PCT/US2008/076859, filed Sep. 18, 2008.

*Primary Examiner*—Laura Tso
(74) *Attorney, Agent, or Firm*—Price, Heneveld, Cooper, DeWitt & Litton, LLP

(57) ABSTRACT

A light module includes one or more LEDs that are encapsulated in a thermoplastic polymer material. Metal conductors and electrical components providing a power supply circuit for the LED are also encapsulated in the thermoplastic polymer material. The conductive material may include a pair of relatively rigid portions that project outwardly from the thermoplastic polymer material to provide for electrical connection of the light module. The body may include connecting surface portions that permit the light module to be connected to a conventional electrical receptacle or the like, such that the light module can be mechanically and electrically connected to a socket or other connector previously utilized for incandescent bulbs.

16 Claims, 10 Drawing Sheets

U.S. PATENT DOCUMENTS

| | | | |
|---|---|---|---|
| 5,641,221 | A | 6/1997 | Schindele et al. |
| 5,649,756 | A | 7/1997 | Adams et al. |
| 5,652,434 | A | 7/1997 | Nakamura et al. |
| 5,669,698 | A | 9/1997 | Veldman et al. |
| 5,669,699 | A | 9/1997 | Pastrick et al. |
| 5,669,704 | A | 9/1997 | Pastrick |
| 5,671,996 | A | 9/1997 | Bos et al. |
| 5,673,994 | A | 10/1997 | Fant, Jr. et al. |
| 5,680,245 | A | 10/1997 | Lynam |
| 5,708,428 | A | 1/1998 | Phillips |
| 5,734,182 | A | 3/1998 | Nakamura et al. |
| 5,746,497 | A | 5/1998 | Machida |
| 5,747,832 | A | 5/1998 | Nakamura et al. |
| 5,752,766 | A | 5/1998 | Bailey et al. |
| 5,765,940 | A | 6/1998 | Levy et al. |
| 5,786,665 | A | 7/1998 | Ohtsuki et al. |
| 5,803,579 | A | 9/1998 | Turnbull et al. |
| 5,806,965 | A | 9/1998 | Deese |
| 5,868,116 | A | 2/1999 | Betts et al. |
| 5,876,107 | A | 3/1999 | Parker et al. |
| 5,877,558 | A | 3/1999 | Nakamura et al. |
| 5,880,486 | A | 3/1999 | Nakamura et al. |
| 5,894,686 | A | 4/1999 | Parker et al. |
| 5,895,115 | A | 4/1999 | Parker et al. |
| 5,915,830 | A | 6/1999 | Dickson et al. |
| 5,921,652 | A | 7/1999 | Parker et al. |
| 5,921,660 | A | 7/1999 | Yu |
| 5,934,798 | A | 8/1999 | Roller et al. |
| 5,938,321 | A | 8/1999 | Bos et al. |
| 5,944,414 | A | 8/1999 | Nishitani et al. |
| 5,947,588 | A | 9/1999 | Huang |
| 5,998,925 | A | 12/1999 | Shimizu et al. |
| 6,005,210 | A | 12/1999 | Chien |
| 6,030,089 | A | 2/2000 | Parker et al. |
| 6,045,240 | A | 4/2000 | Hochstein |
| 6,070,998 | A | 6/2000 | Jennings et al. |
| 6,079,838 | A | 6/2000 | Parker et al. |
| 6,082,870 | A | 7/2000 | George |
| 6,097,501 | A | 8/2000 | Hayashi et al. |
| 6,113,247 | A | 9/2000 | Adams et al. |
| 6,139,172 | A | 10/2000 | Bos et al. |
| 6,152,575 | A | 11/2000 | Montanino |
| 6,152,590 | A | 11/2000 | Furst et al. |
| 6,158,867 | A | 12/2000 | Parker et al. |
| 6,158,882 | A | 12/2000 | Bischoff, Jr. |
| 6,162,381 | A | 12/2000 | Onishi et al. |
| 6,164,805 | A | 12/2000 | Hulse |
| 6,190,026 | B1 | 2/2001 | Moore |
| 6,204,512 | B1 | 3/2001 | Nakamura et al. |
| 6,215,133 | B1 | 4/2001 | Nakamura et al. |
| 6,220,722 | B1 | 4/2001 | Begemann |
| 6,234,648 | B1 | 5/2001 | Borner et al. |
| 6,244,734 | B1 | 6/2001 | Hulse |
| 6,255,613 | B1 | 7/2001 | Yang |
| 6,276,822 | B1 | 8/2001 | Bedrosian et al. |
| 6,283,612 | B1 | 9/2001 | Hunter |
| 6,347,880 | B1 | 2/2002 | Furst et al. |
| 6,357,902 | B1 | 3/2002 | Horowitz |
| 6,371,636 | B1 | 4/2002 | Wesson |
| 6,402,570 | B2 | 6/2002 | Soga et al. |
| 6,404,131 | B1 | 6/2002 | Kawano et al. |
| 6,412,973 | B1 | 7/2002 | Bos et al. |
| 6,419,306 | B2 | 7/2002 | Sano et al. |
| 6,461,017 | B2 | 10/2002 | Selkee |
| 6,469,323 | B1 | 10/2002 | Nakamura et al. |
| 6,531,328 | B1 | 3/2003 | Chen |
| 6,580,228 | B1 | 6/2003 | Chen et al. |
| 6,595,671 | B2 | 7/2003 | Lefebvre et al. |
| 6,598,996 | B1 | 7/2003 | Lodhie |
| 6,604,834 | B2 | 8/2003 | Kalana |
| 6,616,313 | B2 | 9/2003 | Furst et al. |
| 6,617,786 | B1 | 9/2003 | Centofante |
| 6,659,632 | B2 | 12/2003 | Chen |
| 6,669,267 | B1 | 12/2003 | Lynam et al. |
| 6,682,331 | B1 | 1/2004 | Peh et al. |
| 6,709,132 | B2 | 3/2004 | Ishibashi |
| 6,709,137 | B1 | 3/2004 | Glovak et al. |
| 6,726,502 | B1 | 4/2004 | Hayes |
| 6,729,055 | B2 | 5/2004 | Chou |
| 6,739,733 | B1 | 5/2004 | Lamke et al. |
| 6,739,744 | B2 | 5/2004 | Williams et al. |
| 6,755,547 | B2 | 6/2004 | Parker |
| 6,757,969 | B1 | 7/2004 | Chan |
| 6,786,625 | B2 | 9/2004 | Wesson |
| 6,793,371 | B2 | 9/2004 | Lamke et al. |
| 6,814,474 | B2 | 11/2004 | Groeller |
| 6,828,170 | B2 | 12/2004 | Roberts et al. |
| 6,848,818 | B2 | 2/2005 | Huizenga |
| 6,866,394 | B1 | 3/2005 | Hutchins et al. |
| 6,874,925 | B2 | 4/2005 | Page et al. |
| 6,889,456 | B2 | 5/2005 | Shibata et al. |
| 6,899,449 | B2 | 5/2005 | Hatagishi et al. |
| 6,907,643 | B2 | 6/2005 | Koops et al. |
| 6,910,783 | B2 | 6/2005 | Mezei et al. |
| 6,942,360 | B2 | 9/2005 | Chou et al. |
| 6,949,709 | B1 | 9/2005 | Barat et al. |
| 6,971,758 | B2 | 12/2005 | Inui et al. |
| 6,979,100 | B2 | 12/2005 | Reiff et al. |
| 6,988,819 | B2 | 1/2006 | Siktberg et al. |
| 6,997,576 | B1 | 2/2006 | Lodhie et al. |
| 7,055,997 | B2 | 6/2006 | Baek |
| 7,060,542 | B2 | 6/2006 | Nakajima et al. |
| 7,083,311 | B2 | 8/2006 | Schreck et al. |
| 7,086,756 | B2 | 8/2006 | Maxik |
| 7,118,646 | B2 | 10/2006 | Hunkeler |
| 7,128,442 | B2 | 10/2006 | Lee et al. |
| 7,140,751 | B2 | 11/2006 | Lin |
| 7,160,015 | B2 | 1/2007 | Parker |
| 7,175,324 | B2 | 2/2007 | Kwon |
| 7,195,381 | B2 | 3/2007 | Lynam et al. |
| 7,213,952 | B2 | 5/2007 | Iwai |
| 7,220,029 | B2 | 5/2007 | Bynum |
| 7,224,001 | B2 | 5/2007 | Cao |
| 7,249,869 | B2 | 7/2007 | Takahashi et al. |
| 7,265,322 | B2 | 9/2007 | Aengenheyster et al. |
| 7,301,176 | B2 | 11/2007 | Abe et al. |
| 7,333,257 | B2 | 2/2008 | Reynolds et al. |
| 7,357,525 | B2 | 4/2008 | Doyle |
| 7,374,305 | B2 | 5/2008 | Parker |
| 7,380,961 | B2 | 6/2008 | Moriyama et al. |
| 7,384,177 | B2 | 6/2008 | Parker |
| 7,387,420 | B2 | 6/2008 | Ogino et al. |
| 7,402,270 | B2 | 7/2008 | Mercado |
| 7,434,974 | B2 | 10/2008 | Parker |
| 7,448,778 | B2 | 11/2008 | Lin |
| 7,467,887 | B2 | 12/2008 | Parker |
| 2002/0105812 | A1 | 8/2002 | Zimmermann et al. |
| 2004/0114367 | A1 | 6/2004 | Li |
| 2005/0012880 | A1 | 1/2005 | Yoshii et al. |
| 2005/0121829 | A1 | 6/2005 | Spurr et al. |
| 2005/0207176 | A1 | 9/2005 | Johnson et al. |
| 2005/0213351 | A1 | 9/2005 | Yang |
| 2006/0040094 | A1 | 2/2006 | Mizuno et al. |
| 2006/0198155 | A1 | 9/2006 | Nickola et al. |
| 2006/0239037 | A1 | 10/2006 | Repetto et al. |
| 2007/0103902 | A1 | 5/2007 | Hsiao |
| 2007/0133214 | A1 | 6/2007 | Maeda et al. |
| 2007/0196762 | A1 | 8/2007 | Maeda et al. |
| 2007/0257398 | A1 | 11/2007 | Moncrieff |
| 2007/0259576 | A1 | 11/2007 | Brandt et al. |
| 2007/0274648 | A1 | 11/2007 | Ip |
| 2008/0066355 | A1 | 3/2008 | Misawa et al. |
| 2008/0106187 | A1 | 5/2008 | Suzuki et al. |
| 2008/0170405 | A1 | 7/2008 | Kamiya et al. |

2008/0259642 A1 10/2008 Parker

FOREIGN PATENT DOCUMENTS

| | | | |
|---|---|---|---|
| DE | 298 11 417 | U1 | 10/1998 |
| DE | 198 05 771 | A1 | 8/1999 |
| JP | 1988 63292690 | | 11/1988 |
| JP | 1990 2058892 | | 2/1990 |
| JP | 1999 11220239 | | 8/1999 |
| JP | 2002096680 | | 4/2002 |
| JP | 2002287671 | | 10/2002 |
| JP | 2005134789 | | 5/2005 |
| JP | 2005221661 | | 8/2005 |
| JP | 2006062431 | | 3/2006 |
| JP | 2008070697 | | 3/2008 |
| WO | 97/48134 | | 12/1997 |
| WO | 97/50132 | | 12/1997 |
| WO | 00/55685 | | 9/2000 |
| WO | 00/55914 | | 9/2000 |

FIG. 1
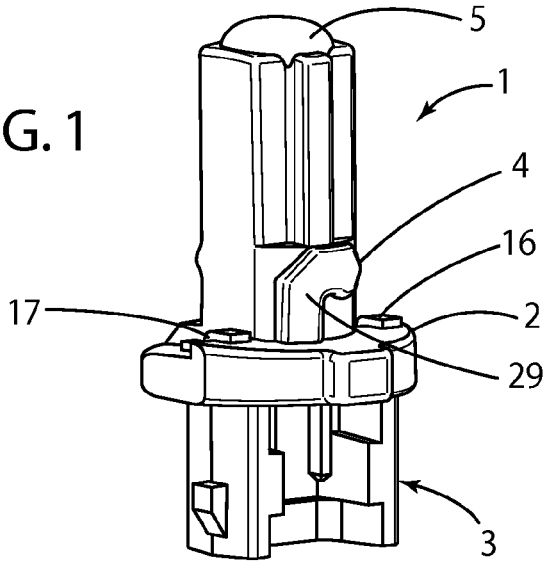
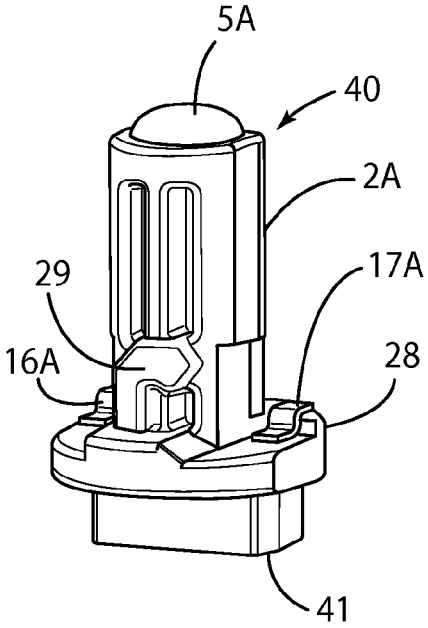
FIG. 5
FIG. 6
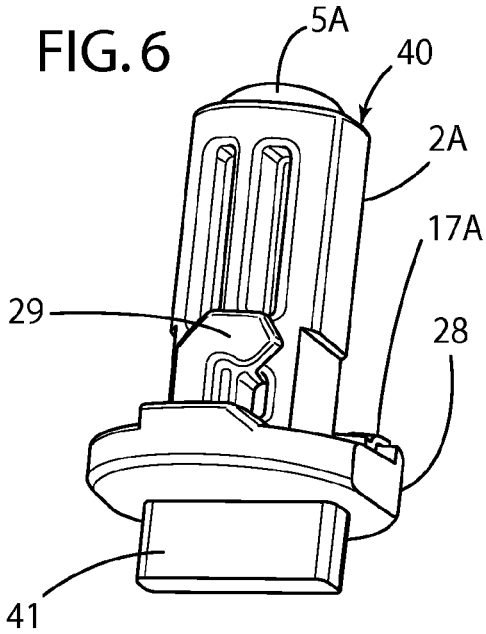

FIG. 7
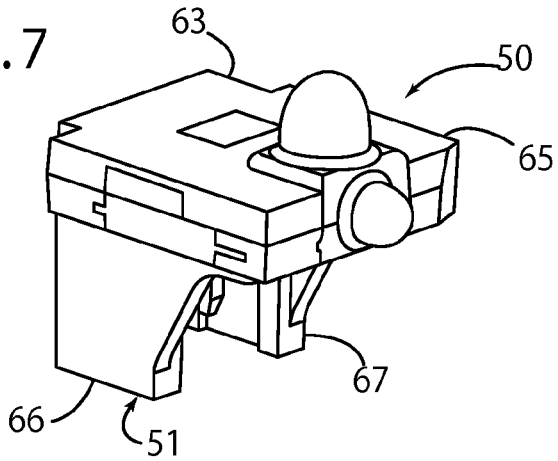
FIG. 8
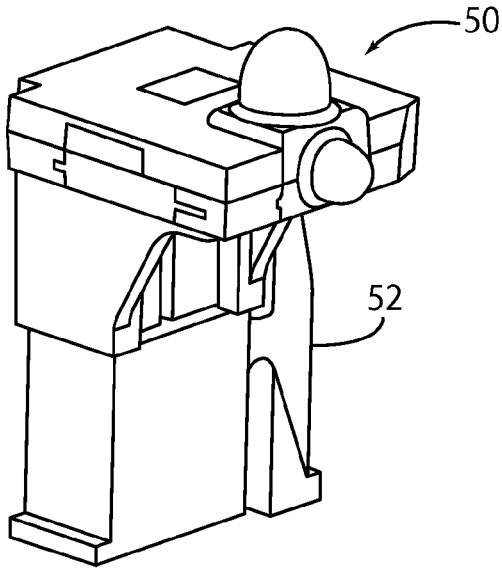
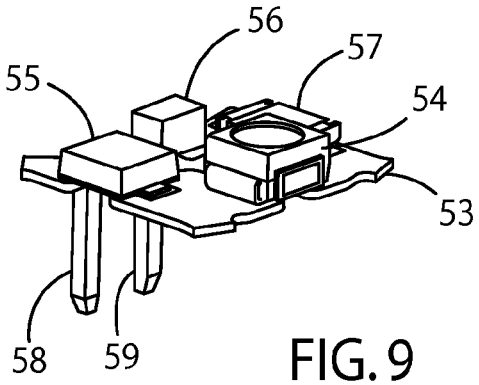
FIG. 9

FIG. 10
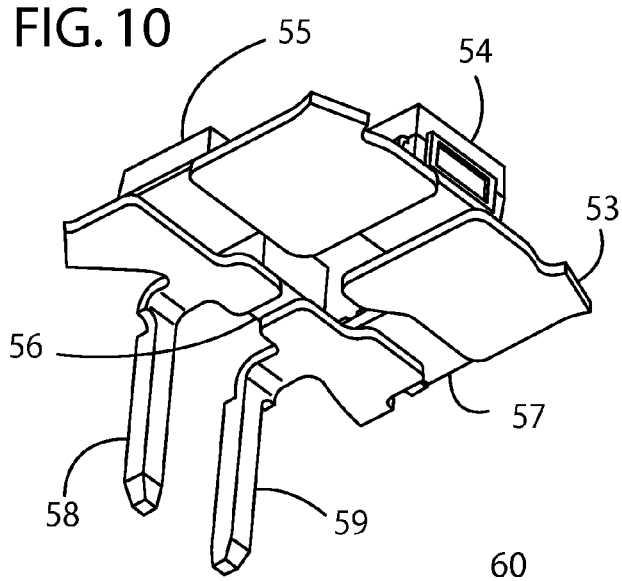
FIG. 11
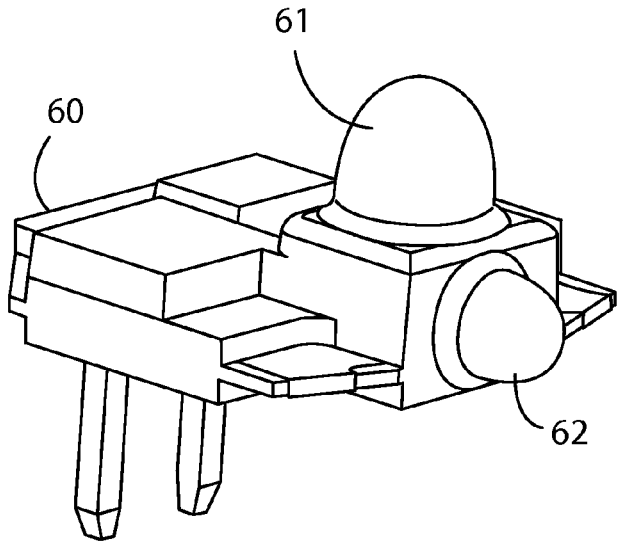
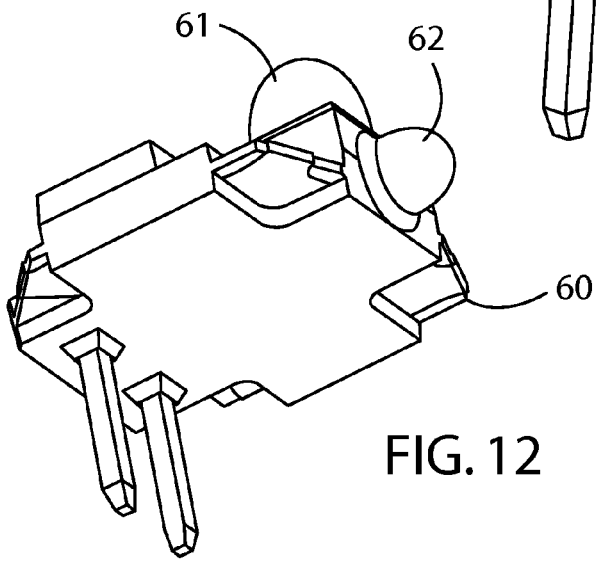
FIG. 12

LIGHT MODULE

CROSS REFERENCE TO RELATED APPLICATIONS

This application claims the benefit of U.S. Provisional Application No. 61/019,988, filed on Jan. 9, 2008, entitled LIGHT MODULE, the entire contents of which are incorporated herein by reference.

BACKGROUND OF THE INVENTION

Various types of incandescent lights have been developed for use in a wide range of applications. For example, incandescent lights may be used for vehicle interior and/or exterior lighting. Incandescent vehicle lights are typically connected to a 12-volt DC power source.

BRIEF DESCRIPTION OF THE DRAWINGS

FIG. 1 is an isometric view of a light module according to one aspect of the present invention;

FIG. 5 is an isometric view of a light module according to another aspect of the present invention;

FIG. 6 is an isometric view of the light module of FIG. 5 from a different angle;

FIG. 7 is an isometric view of a light module according to another aspect of the present invention;

FIG. 8 is an isometric view of the light module of FIG. 7, wherein the light module is connected to a connector;

FIG. 9 is an isometric view of the light module of FIG. 7 during fabrication;

FIG. 10 is an isometric view of the partial assembly of FIG. 9 from another angle;

FIG. 11 is an isometric view of a partially assembled light module;

FIG. 12 is an isometric view of the partially assembled light module of FIG. 11 from a different angle;

DETAILED DESCRIPTION OF PREFERRED EMBODIMENT

Figure 2:
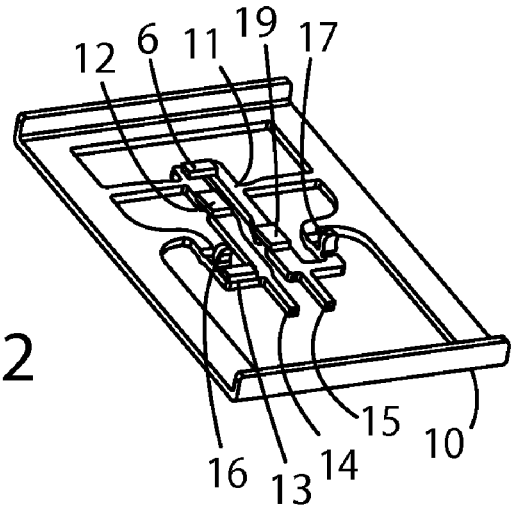
FIG. 2 is an isometric view of a metal lattice with electrical components attached thereto utilized to fabricate the light module of FIG. 1.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a light unit or module 1 includes a body 2 that is molded of a polymer material. The light unit 1 includes a first connector 3 that may be utilized to connect the light unit 1 to a plug-in type receptacle. The light module 1 may also include a second connector 4 utilized to connect the light unit 1 to a ¼-turn type receptacle. The body 2 may be molded from a transparent or translucent light-transmitting polymer material, and may include an integral lens 5 that diffuses or directs light from an LED 6 (see also FIG. 2) in a desired pattern as required for a particular lighting application. The integral lens 5 may provide, for example, a relatively narrow beam of light having relatively high intensity for reading, or other tasks. Alternately, the integral lens 5 may diffuse the light to provide for ambient lighting. According to one aspect of the present invention, the integral lens 5 may be configured to provide task lighting or ambient lighting for a vehicle interior. Integral lens 5 may be configured according to U.S. Provisional Patent Application No. 60/910,691, filed on Apr. 9, 2007, the entire connects of which are incorporated by reference. As described in more detail below, the polymer body 2 is molded around the LED 6 and other internal components to thereby substantially seal off the internal components with respect to atmospheric moisture and the like.

With further reference to FIG. 2, during fabrication of light module 1, a metal lattice 10 is formed from sheet metal or other conductive material utilizing a sheet metal stamping die or the like. Electrical circuit elements or conductors 11 are formed in the metal lattice 10, and the LED 6 and other electrical components are secured to the circuit elements 11 utilizing soldering or other suitable techniques. In the illustrated example, a resistor 12, capacitor 13, and diode 19 are attached to the circuit elements 11 to form an electrical circuit that drives LED 6. Various electrical circuits suitable for driving LED 6 are known, such that the electrical circuit elements 11 and electrical components will not be described in detail herein. The electrical components 12, 13, and 19 may be configured to form an electrical circuit that drives the LED 6 when light module 1 is connected to a conventional 12-volt DC power source or other DC power source. The electrical circuit may also be configured to drive an LED 6 when the light module 1 is connected to other power sources, such as a 120-volt AC power source. In the illustrated example, the electrical circuit elements 11 include prongs 14 and 15 that form a part of the first connector 3 (FIG. 1) that may be utilized to secure the light module 1 to a conventional plug-in type receptacle. A pair of transverse protrusions 16 and 17 may also be formed in the electrical circuit elements 11. As described in more detail below, the transverse protrusions 16 and 17 provide for electrical connection to a conventional ¼-turn electrical connector. One or more bridge portions 18 of metal lattice 10 are initially formed to support the electrical circuit elements 11 and electrical components 12 and 13 during fabrication. As described in more detail below, the electrical circuit elements 11 are cut free from the bridge portions 18 of metal lattice 10 to form the finished light module 1 (FIG. 1).

Figure 3:
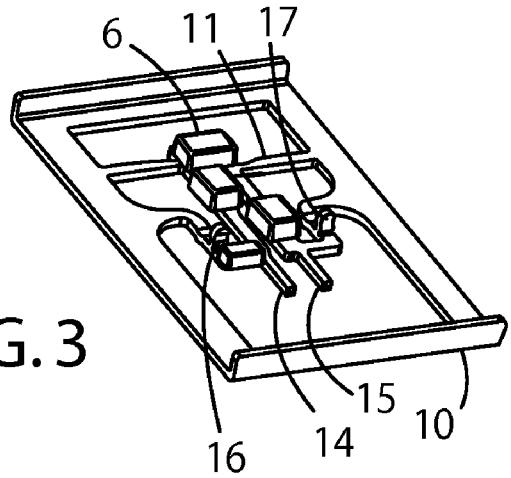
FIG. 3 is an isometric view of the metal lattice of FIG. 2 after a first molding step.

With further reference to FIG. 3, during fabrication of light module 1, at least a portion of metal lattice 10 is positioned in a mold tool (not shown), and a first shot of polymer material 20 is injected over at least a portion of the electrical circuit elements 11 to thereby encapsulate one or more of the LED 6 and/or the electrical components 12, 13, and 19. The polymer material 20 formed during this first molding step may be molded around the LED 6 and/or electrical components 12, 13, and 19 in substantially the same manner as described in detail in co-pending patent application Ser. No. 11/842,606, filed on Aug. 21, 2007, entitled ELECTRICAL DEVICE HAVING BOARDLESS ELECTRICAL COMPONENT MOUNTING ARRANGEMENT, the entire contents of which are incorporated by reference.

As described in detail in the 11/842,606 application, a relatively small amount of polymer material 20 is initially molded around the LED 6 and electrical components. Because a relatively small amount of polymer material 20 is initially formed around the LED 6 and electrical components, the pressures, forces, and/or temperatures to which these components are exposed can be controlled to avoid damage. The polymer material 20 formed during the first molding step thereby provides a protective envelope that encapsulates the electrical components to provide for one or more additional molding steps.

Figure 4:
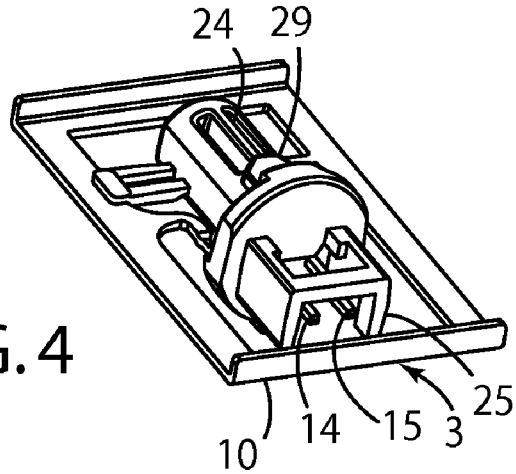
FIG. 4 is an isometric view of the metal lattice of FIG. 3 after a second molding step.

With further reference to FIG. 4, additional polymer material 24 is then molded over the first polymer material 20 in a second cavity of a mold tool (not shown). The additional polymer material 24 may have a composition that is substantially identical to the first polymer material 20, such that the first polymer material 20 and second polymer material 24 fuse or melt together to form a substantially continuous, one-piece polymer body 2. The electrical circuit elements 11 may be cut free from the bridge portions 18 of the metal lattice 10 before or after injection of the additional polymer material 24. Thus, although the light module 1 is shown in FIG. 4 as being connected to the metal lattice 10, it will be understood that the light module 1 may be disconnected from the metal lattice 10 prior to injection of the additional polymer material 24. Also, the bridge portions 18 may be severed at the time the first polymer material 20 is molded around the circuit elements 11 and electrical components 6, 11, 12, and 19, and a polymer bridge may be formed at the time the first polymer material 20 is molded over the components 6, 11, 12, and 19 to interconnect the circuit elements 11 to the metal lattice 10. The polymer bridge material is removed at the time the additional polymer material 24 is molded over the first polymer material 20.

The second mold cavity (not shown) is configured to form an extension 25 that, in combination with the prongs 14 and 15, forms the first connector 3 that can be utilized to connect the light module 1 to a conventional plug-in type electrical receptacle. Transverse protrusions 16 and 17 (see also FIG. 1) of the electrical circuit 11 project outwardly from a disk-like base portion 28 of body 2. Also, a pair of raised portions 29 are formed on cylindrical main portion 30 of body 2. The transverse protrusions 16 and 17 of electrical circuit elements 11, base portion 28, and raised portions 29 together form a ¼-turn connector that may be utilized to mechanically and electrically connect the light unit 1 to a convention ¼-turn receptacle/socket. The shape and size of raised portions 29 may be substantially the same as known ¼-turn bulb connectors.

With further reference to FIGS. 5 and 6, a light module 40 according to another aspect of the present invention includes a body 2A and lens 5A. Light module 40 may include an LED and electrical components that are substantially the same as those described in more detail above in connection with the light module 1 of FIGS. 1-4. Light module 40 includes transverse protrusions 16A and 17A that together form a ¼-turn connector. However, light module 40 does not include a first connector 3 for connection to a plug-in type receptacle. Rather, body 2A of light module 40 includes an extension 41 having a relatively flat shape to thereby form a handle that can be grasped by a user to twist the light module 40 during installation into a ¼-turn connector.

The light modules 1 and 40 of the present invention provide an LED light module that can be connected to a conventional incandescent receptacle or ¼-turn connector. The light modules 1 and 40 include a circuit that provides the proper voltage and current to drive the LEDs from a 12-volt DC or 120-volt AC power source, such that additional circuits or the like are not required to power the LED light. Furthermore, because the LED, electrical circuit elements, and electrical components are substantially encapsulated in the polymer material, the polymer material substantially protects the LED and/other electrical components from ambient moisture and the like.

With further reference to FIGS. 7 and 8, a light module 50 according to another aspect of the present invention includes a plug-type connector 51 that permits the light module 50 to be connected to a conventional electrical connector 52 (FIG. 8).

With further reference to FIG. 9, during fabrication, a circuit 53 is formed from sheet metal or other conductive material, and an LED 54, diode 55, capacitor 56, and a resistor 57 or other electrical components are soldered to the metal circuit 53. The metal circuit 53 may be formed by a metal lattice (not shown) that is substantially similar to the metal lattice 10 described in more detail above in connection with FIGS. 2-4. The metal circuit 53 includes a pair of transversely-extending prongs 58 and 59 (see also FIG. 10) that form plug-type connector 51 (FIG. 7) of light module 50.

With further reference to FIGS. 11 and 12, after the electrical components are soldered or otherwise connected to the metal circuit 53, polymer material 60 is molded around the LED 54, diode 55, capacitor 56, and resistor 57 in a first molding shot. In the illustrated example, the polymer material 60 is configured to form a first lens 61 and a second lens 62. LED 54 may be either a top-emitting LED, or a side-emitting LED. Because the polymer material 60 forms both a first lens 61 and a second lens 62, either a top-emitting LED or side-emitting LED may be utilized to form the light module 50, without requiring use of a second mold tool. The polymer material 60 may form relatively small capsules around the electrical components such as the LED 54, diode 55, capacitor 56, and resistor 57 as described in more detail above in connection with FIGS. 2-5 to thereby protect these components during further molding steps. The lenses 61 and 62 may be configured to direct, diffuse, or otherwise control the distribution of light from LED 54 to provide a light intensity distribution as required for a particular application.

After the first polymer material 60 (FIGS. 11 and 12) is molded over the metal circuit 53 and electrical components, the partially-fabricated unit is placed in second mold cavity (not shown), and additional polymer material 63 (FIG. 7) is molded over the first polymer material 60 to form polymer body 65 of light module 50. The polymer material 63 includes portions 66 and 67 extending around the prongs 58 and 59 to form the plug-type connector 51.

Figure 13:
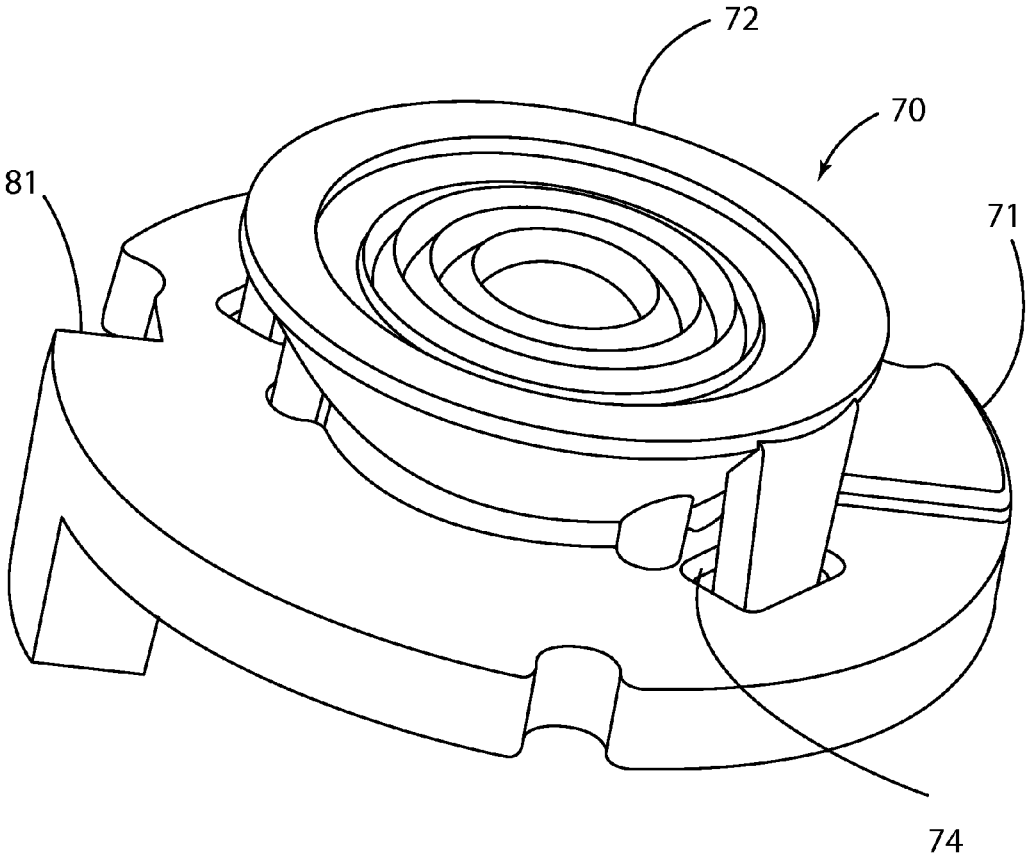
FIG. 13 is an isometric view of a light module assembly according to another aspect of the present invention.
Figure 14:
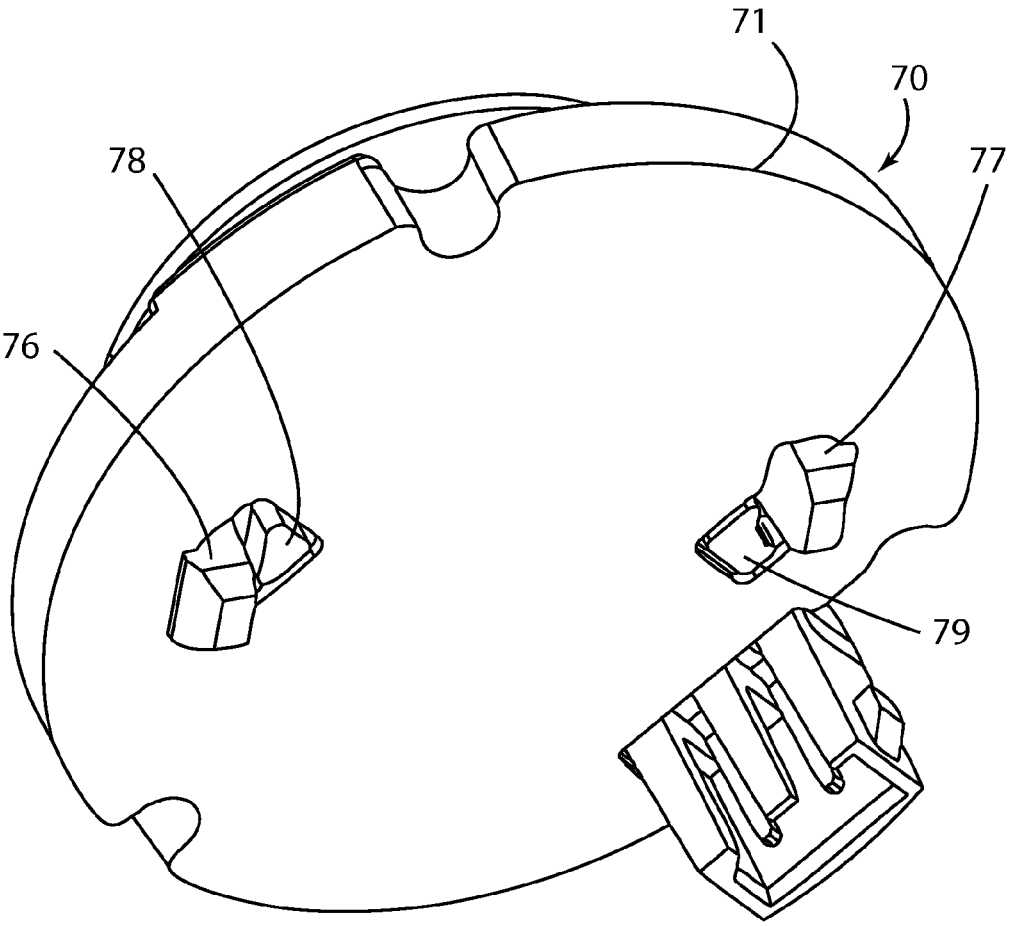
FIG. 14 is an isometric view of the light module assembly of FIG. 13 from a different angle.
Figure 15:
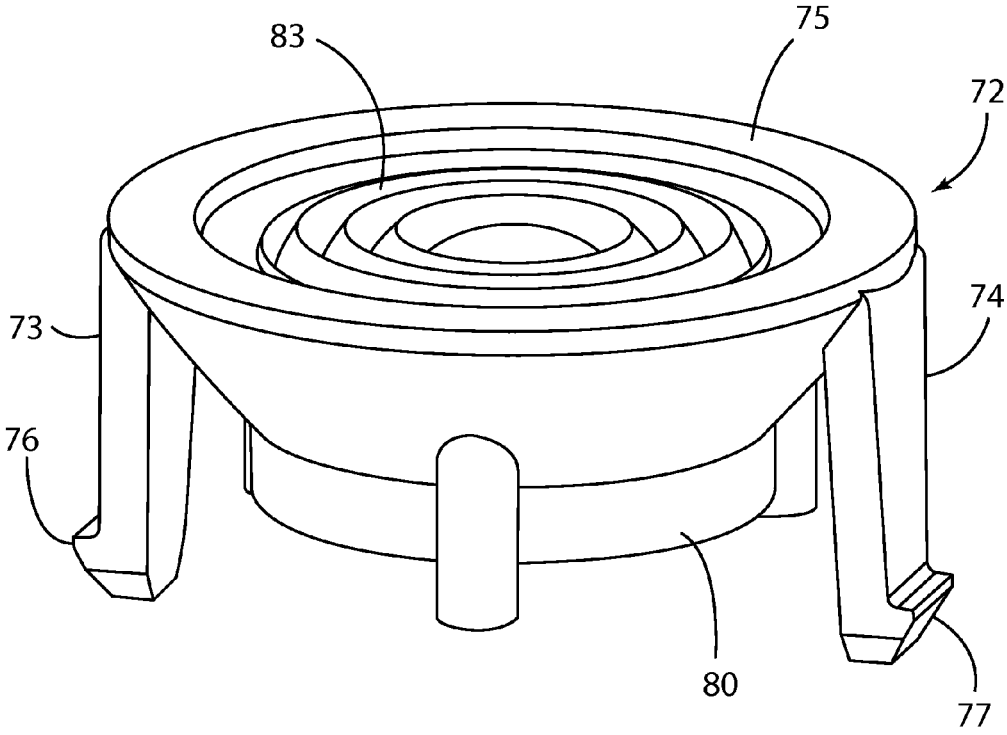
FIG. 15 is an isometric view of a lens that forms a portion of the light module assembly of FIGS. 13 and 14.
Figure 16:
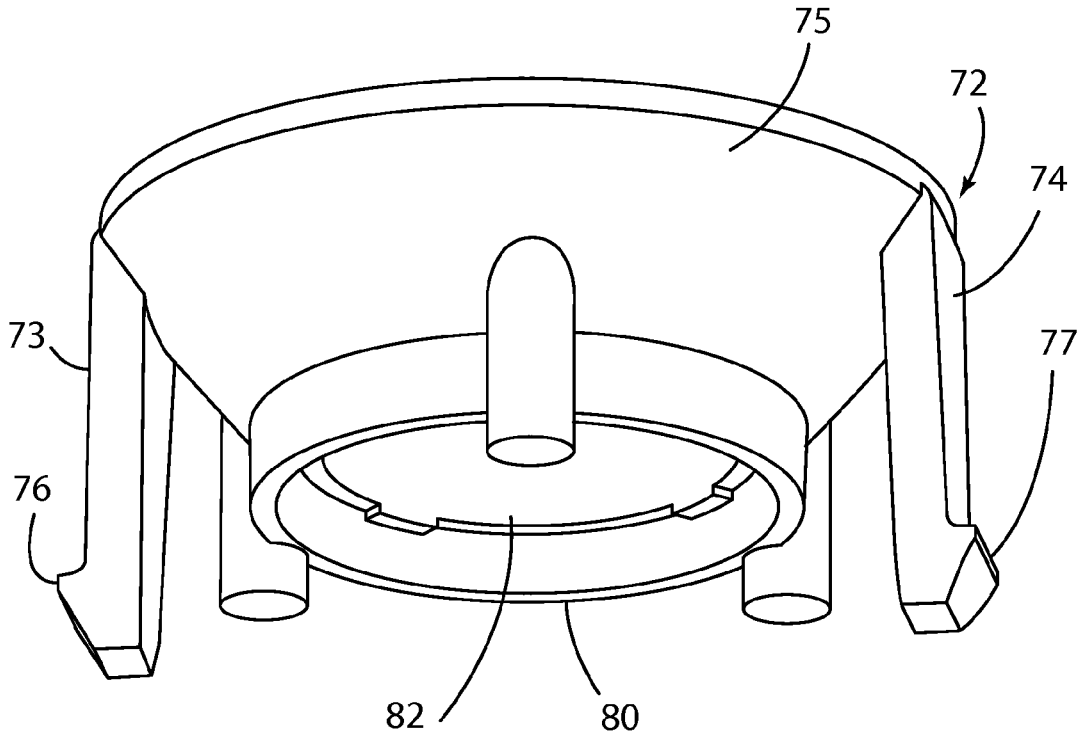
FIG. 16 is an isometric view of the lens of FIG. 15 from a different angle.

With further reference to FIGS. 13 and 14, a light assembly 70 according to another aspect of the present invention includes a base 71, and a lens 72 that is attached to the base 71. With further reference to FIGS. 15 and 16, lens 72 includes a pair of arms or extensions 73 and 74 that are integrally formed with the body portion 75 of the lens 72. The extensions 73 and 74 include barb-like connectors 76 and 77 that are received in openings 78 and 79 (FIG. 14) to thereby connect the lens 72 to the base 71. A cylindrical wall or flange 80 projects downwardly from the body portion 75 of lens 72, and abuts an upper surface 81 of base 71 when the lens 72 is assembled to the base 71. As described in more detail below, an LED positioned in the base 71 is thereby positioned in alignment with a cavity 82 formed by cylindrical wall or flange 80, and the light from the LED is thereby directed by the lens 72 to provide the desired light intensity distribution. In the illustrated example, lens 72 includes a plurality of concentric ridges 83 that form a Fresnel type lens. The lens 72 may be configured according to the invention described in U.S. Provisional Application No. 60/910,691, the entire contents of which are incorporated by reference. Lens 72 may include a ball and socket type connector that permits the lens 72 to pivot about at least two axes to direct light in a desired direction.

Figure 17:
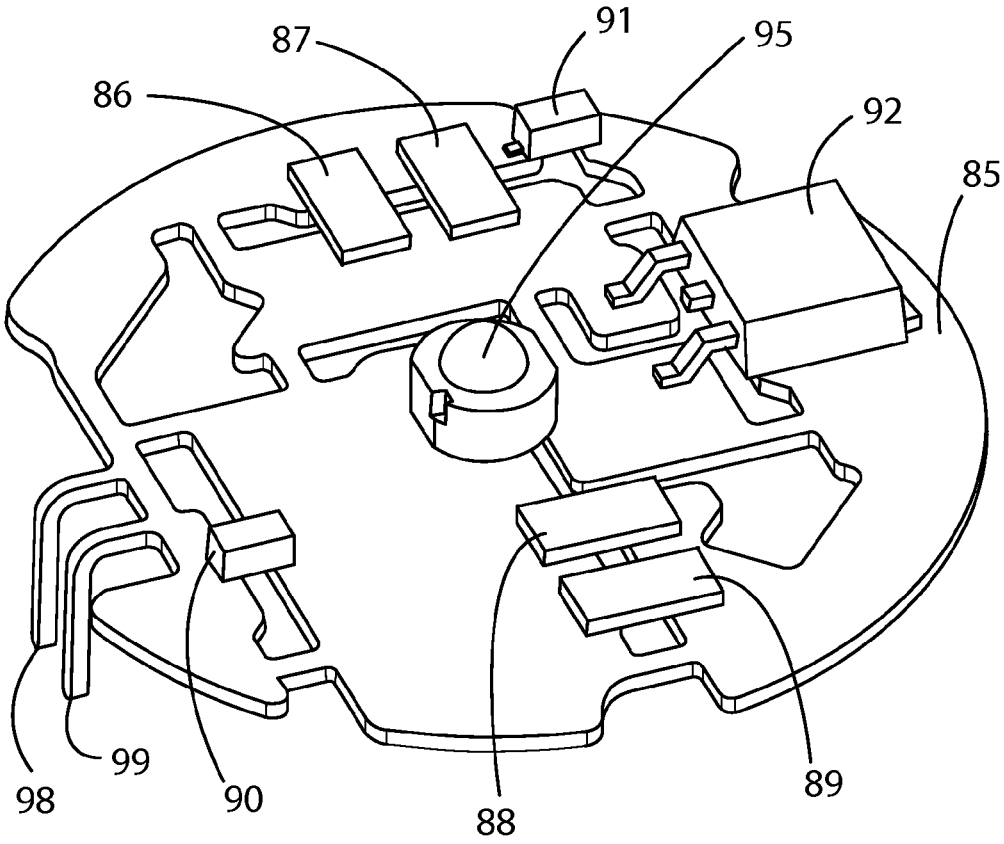
FIG. 17 is an isometric view of a portion of the light assembly of FIG. 13 during fabrication.

During fabrication of base 71 of light assembly 70, a metal circuit 85 (FIG. 17) is formed, and a plurality of electrical components such as resistors 86-89, and other components 90-92 are connected to the metal circuit 85 utilizing soldering or other appropriate techniques. In the illustrated example, components 90 and 91 are diodes, and component 92 comprises a transistor. An LED 95 is also connected to metal circuit 85. After the electrical components are secured to the metal circuit 85, small plastic capsule portions (not shown) are molded over one or more of the electrical components 86-92. The capsule portions may be molded in substantially the same manner as described in detail in co-pending U.S. patent application Ser. No. 11/842,606.

Figure 18:
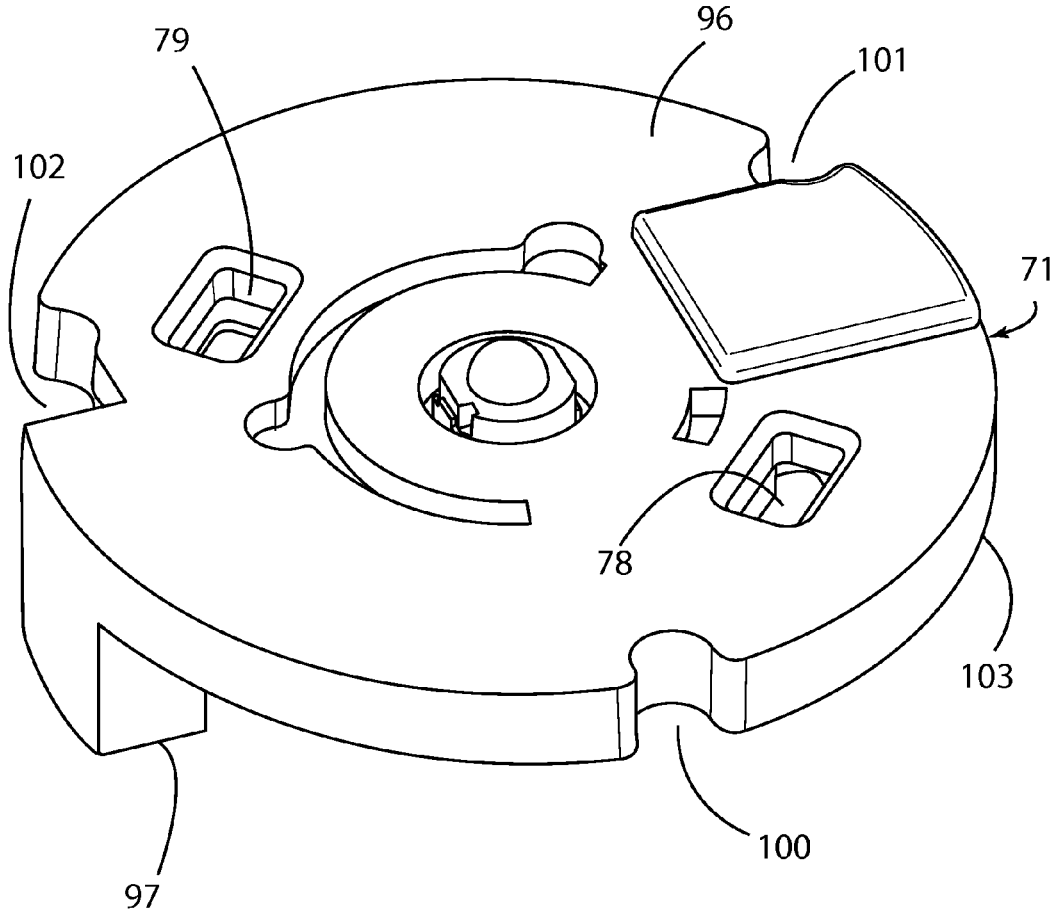
FIG. 18 is an isometric view of a portion of the light assembly of FIG. 13 during fabrication.

One or more additional molding shots are then utilized to form a one-piece polymer layer or body 96 of the base 71 as shown in FIG. 18. The polymer body 96 may form a plug-type connector 97 extending around prongs 98 and 99 (FIG. 17) of the metal circuit 85. The lens 72 is then connected to the base 71 by inserting barb-like connector 76 and 77 (FIG. 15) of lens 72 into openings 78 and 79, respectively (FIG. 18) of base 71. One or more indentations 100-102 may be formed in a peripheral edge portion 103 of base 71 to provide clearance for conventional mechanical connectors or the like (not shown) which may be utilized to secure the light assembly 70 to a mounting surface such as a vehicle roof structure door, dashboard, or other vehicle structure.

In addition to the bulb/connectors described above in connection with FIGS. 1-18, a light module according to the present invention may comprise other types of bulb bases/connectors. For example, the light module may comprise a cartridge type of bulb/connector as disclosed in U.S. patent application Ser. No. 11/758,942, entitled PLATED STEEL ELECTRICAL CIRCUIT COMPONENTS AND METHOD, filed on Jun. 6, 2007, the entire contents of which are incorporated by reference. The light module may also comprise a "bayonet" type connector including a socket formed by a sheet metal cylinder with a pair of J-shaped slots that receive outwardly-projecting pins on the bulb, and a resilient member that biases the bulb outwardly. In use, the bulb base is inserted into the socket and rotated to engage the pins in the hooked end portions of the J-shaped slots. Such bulbs are designated B, BA, or BY type bulbs. The light module may also comprise a candelabra bulb, such as the E5, E12, E17, E26, and E39 type bulbs. Still further, a light module according to the present invention may comprise a GY or G pin base bulb. Still further, the light module may comprise a "wedge base" type module.

In general, in each case the light module may be formed utilizing conductors forming a lattice such as the metal lattice 10 described in more detail above in connection with FIGS. 2-4. One or more electrical components and one more LEDs are then mounted to the conductors, and thermoplastic polymer material is then molded over the electrical components and the LED(s) in substantially the same manner as discussed above in connection with FIGS. 2-4. The conductors may be formed to provide an electrical connection as required for a particular type of bulb base such as a pin base, cartridge base, or wedge base. Alternately, the conductors may be electrically connected to other conductive components such as a screw base to form the bulb base.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A light module, comprising:

an electrically conductive assembly comprising at least a pair of metal conductors, the pair of metal conductors together forming a generally planar mounting area, the pair of metal conductors including first and second rigid prongs;

at least one LED mounted to the mounting area of the metal conductors;

at least one electrical component mounted to the pair of metal conductors to form an electrical circuit controlling at least one of a voltage and a current applied to the prongs;

a body made of a light-transmitting thermoplastic polymer material encapsulating the one LED and the one electrical component, the body including mounting surface portions adjacent the first and second prongs that form a mechanical connector whereby the light module can be electrically and mechanically connected to an electrical receptacle by movement of the light module relative to an electrical connector.

2. The light module of claim 1, wherein:

the first and second prongs extend transversely away from the planar mounting area; and:

the mounting surface portions are parallel to the first and second prongs.

3. The light module of claim 2, wherein:

the mounting surface portions from a cavity, and the first and second prongs are disposed in the cavity.

4. The light module of claim 1, wherein:

the mounting surface portions comprise a quarter-turn connector.

5. The light module of claim 4, wherein:

the body includes a generally cylindrical portion and a flange portion projecting outwardly from the cylindrical portion.

6. The light module of claim 5, wherein:

the flange portion includes a generally circular peripheral outer edge surface.

7. The light module of claim 5, wherein:

the cylindrical portion defines a first end and includes a convex surface at the first end forming a lens.

8. The light module of claim 1, including:

a lens having a cavity on a first side of the lens, wherein the lens is connected to the light module with the cavity in registry with the LED.

9. The light module of claim 8, wherein:

the lens includes a plurality of concentric raised ridges on a second side of the lens opposite the first side of the lens.

10. The light module of claim 8, wherein:

the lens includes a plurality of flexible arms having barbed connectors connecting the lens to the light module.

11. The light module of claim 1, wherein:

the body includes a first lens facing a first direction, and a second lens facing in a second direction that is transverse to the first direction.

12. The light module of claim 11, wherein:

the first lens comprises a first convex surface portion of the body.

13. The light module of claim 12, wherein:

the second lens comprises a second convex surface portion of the body.

14. The light module of claim 13, wherein:

the first and second convex surface portions face outwardly at substantially right angles relative to one another.

15. The light module of claim 11, wherein:

the LED comprises a side-emitting LED.

16. The light module of claim 11, wherein:

the LED comprises a front-emitting LED.

* * * * *